US012589423B2

(12) United States Patent
De Luca et al.

(10) Patent No.: US 12,589,423 B2
(45) Date of Patent: Mar. 31, 2026

(54) PROCESS AND APPARATUS FOR PRODUCING METALLURGICAL PRODUCTS, IN PARTICULAR OF THE MERCHANT TYPE, IN PARTICULAR IN AN ENDLESS MODE

(71) Applicant: DANIELI & C. OFFICINE MECCANICHE S.p.A., Buttrio (IT)

(72) Inventors: Andrea De Luca, Remanzacco (IT); Federico Tortul, Gradisca d'Isonzo (IT); Damiano Vinetti, Nimis (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 210 days.

(21) Appl. No.: 18/042,540

(22) PCT Filed: Aug. 24, 2021

(86) PCT No.: PCT/IB2021/057752
§ 371 (c)(1),
(2) Date: Feb. 22, 2023

(87) PCT Pub. No.: WO2022/043871
PCT Pub. Date: Mar. 3, 2022

(65) Prior Publication Data

US 2024/0009724 A1 Jan. 11, 2024

(30) Foreign Application Priority Data

Aug. 26, 2020 (IT) ..... 102020000020434

(51) Int. Cl.
*B21B 45/00* (2006.01)
*B21B 1/18* (2006.01)
*B21B 1/46* (2006.01)

(52) U.S. Cl.
CPC ..... *B21B 45/004* (2013.01); *B21B 1/18* (2013.01); *B21B 1/46* (2013.01); *B21B 1/463* (2013.01)

(58) Field of Classification Search
CPC B21B 45/004; B21B 1/18; B21B 1/46; B21B 1/463; B22D 11/06
See application file for complete search history.

(56) References Cited

U.S. PATENT DOCUMENTS 3,625,043 A 12/1971 Josef et al.
6,092,586 A * 7/2000 Schonbeck ..... C21D 8/0226 164/476

FOREIGN PATENT DOCUMENTS

DE 19518144 A1 11/1995
DE 19613718 C1 10/1997
(Continued)

OTHER PUBLICATIONS

Translation of WO-8911363.*
(Continued)

*Primary Examiner* — Bobby Yeonjin Kim
(74) *Attorney, Agent, or Firm* — Stetina Garred Brucker & Newboles

(57) ABSTRACT

A process for producing metallurgical products, in particular at least of the merchant type,
in which there are provided the steps of:
a) producing a long casting product by means of a continuous casting machine;
b) rolling said long casting product by means of a rolling mill comprising a plurality of rolling stand groups;
wherein during step b), said long casting product is heated by first heating means exclusively arranged between one pair of consecutive rolling stand groups;
(Continued)

wherein said first heating means are the only heating means between the rolling stand groups of the rolling mill; and an apparatus adapted to perform the aforesaid process.

11 Claims, 7 Drawing Sheets

(56) References Cited

FOREIGN PATENT DOCUMENTS

| | | | | | |
|---|---|---|---|---|---|
| DE | 19654063 | A1 | | 6/1998 | |
| DE | 102009037278 | A1 | | 2/2011 | |
| JP | S6240904 | A | | 2/1987 | |
| KR | 20110139075 | A | * | 12/2011 | ..... B21B 39/004 |
| RU | 2676113 | C2 | * | 12/2018 | ..... B22D 11/041 |
| WO | WO-8911363 | A | * | 11/1989 | |

OTHER PUBLICATIONS

Translation of KR-20110139075.*
Translation of RU-2676113.*
European Patent Office, Communication pursuant to Article 94(3) EPC, Jul. 7, 2024, 5 pages.
Patent Cooperation Treaty, International Search Report and Written Opinion for International Application No. PCT/IB2021/057752, Jan. 7, 2022, 8 pages.
Bhowmik B et al: "On Line Laser Diameter Gauge for Round Products", Steel Times International, DMG World Media, Lewes, GB, vol. 27, No. 2, Feb. 1, 2002 (Feb. 1, 2002), p. 25/26, XP001116389, ISSN: 0143-7798.

* cited by examiner 13
11
12
1

PROCESS AND APPARATUS FOR PRODUCING METALLURGICAL PRODUCTS, IN PARTICULAR OF THE MERCHANT TYPE, IN PARTICULAR IN AN ENDLESS MODE

CROSS-REFERENCE TO RELATED APPLICATIONS

This application claims priority to PCT International Application No. PCT/IB2021/057752 filed on Aug. 24, 2021, which applications claims priority to Italian Patent Application No. 102020000020434 filed on Aug. 26, 2020, the entire disclosures of which are expressly incorporated herein by reference.

STATEMENT RE: FEDERALLY SPONSORED RESEARCH/DEVELOPMENT

Not Applicable

BACKGROUND

Field of the Invention

The present invention relates to the field of rolling long products—in particular to the field of casting and rolling products which have a polygonal section, in particular a square, rectangular (with ratio between wide side and narrow side less than 4) or octagonal section, or having oval or round section—for producing metallurgical products, in particular metallurgical products of the merchant type.

Background Art and Background of the Invention

In known rolling plants, the products in the merchant categories (the set of profiles including, for example flat bars, section bars, angle bars of various types, for example U, T, V, L, H, C, UPN angle bars, beams, in general of over 20 mm in section size) are produced in a billet-to-billet mode.

This means that a plurality of individual billets are typically cast by multi-line casting machines, all cut to a standard measure (for example 6 m, 13 m, etc.) and sent to a storage and possibly cooling bed. When they are to be rolled, said individual billets are sent one by one to a heating furnace to then be rolled. It is also normal procedure to let them cool to then be rolled later, the rolling depending on the production needs.

Rolling is to be performed at high speed to allow the product to remain above about 800° C. during the entire rolling stage. In particular, said temperature is to be maintained at least up to the last rolling stand of the finishing unit. Indeed, surface defects are avoided above this temperature.

Therefore, according to the prior art, the rolling of merchant products is entirely unassociated from the casting and as mentioned, is performed in a billet-to-billet mode at high speeds (also a few tens of m/min).

The classical layout for rolling merchant products is diagrammatically shown in FIG. 1A.

FIG. 1A shows, in particular, the continuous casting machine 121 and a rolling mill comprising three rolling stand groups 131, 133, 134. There are cutting means 190 between the continuous casting machine 121 and the rolling mill, in particular adapted to perform oxygen cutting to cut the casting product to work in a billet-to-billet mode.

During rolling in a billet-to-billet mode, each billet is cut by the cutting means 191 and/or the cutting means 192 arranged between the roughing stand group 131 and the intermediate stand group 133 and between the intermediate stand group 133 and the finishing stand group 134, respectively.

The classical layout for rolling merchant products indeed provides a first loading area of the previously cast (and typically cold) billets, a furnace for heating them to the optimal temperature for rolling, and a successive rolling line (also referred to as a rolling mill) consisting of various rolling stands (for example, twenty stands) which in sequence bring about the deformation required to shape the desired finished products.

It should be noted that in the rolling plants for merchant products belonging to the prior art, the heating furnace upstream of the rolling line is the only active source for bringing heat to the product, whereby it is essential for the rolling speed in known plants to be high in order not to have excessive drops in temperature which may affect the quality of the product.

Usually, however, excessive lowering of temperature has been encountered in the heads (and often also in the tails) thereof during the crossing of the stands belonging to the rolling mill since the rolling is performed for individual billets (this cooling also changes from product to product as a function of the rolling speed, geometry of the product in the various steps and the steel grade). Such cold heads may result in the risk of cobbling in addition to objective difficulties in rolling since they are harder to roll, whereby they are to be removed by suitable shears arranged along the rolling mill, for example at one third and about two thirds of the length of the rolling mill. Occasionally, also some tails are to be removed and often the cut is not very simple to perform accurately since the merchant products have particular and in some cases even non-symmetrical shapes and sections.

It is easy to understand how disadvantageously these required cropping operations become a significant loss of product, especially the first cropping, since the section of the product being rolled is high. Moreover, the cropping operations make managing the lengths of finished product contained in each billet critical: a 6.5 m billet may give rise to the exiting of a long angular product, also longer than 130 m, from the twentieth stand. Supposing that the finished product to be sold is to be shaped into 12 m bars, there would be ten bars 12 m long, with a short leftover bar of 10 m. If some other cropping operations were required prior to the exiting from the rolling mill, the calculation of the finished bars and short bars would need to be revised and decreased.

Therefore, optimizing the finished products which may be produced from each billet is complex in the rolling mills for merchant products belonging to the prior art, given that the cropping operations may continuously change the possibilities.

Short bars are a strongly felt problem because they are to be disposed of if they are too short, and they end up on a secondary market if they are non-standard. Moreover, there is a need for dedicated equipment to manage and move them.

The phenomenon of short bars occurs when the billets cannot be perfectly divided into multiples of commercial lengths (for example, due to intermediate cropping operations, incorrect drawing between stands, wear of the channels bringing increased influx of material in rolling steps which would require less thereof, etc.) due to the multiple conditions to which they are subjected during the rolling stage. Thus, bars are to be at least partly discarded since they would not be manageable in the cooling bed and would result in uneven cooling of the contiguous bars in the cooling bed. The classical merchant layout then includes a thermal product treatment system, a system for measuring the tolerance of the exiting profile, and shears for hot cutting the product at high speed, at the outlet of the rolling mill. Said shears start to operate when the rolled billet exiting from the rolling mill has an excessive length with respect to the cooling bed downstream.

Indeed returning to the previous example, supposing that the cooling bed has a maximum length of 120 m, while the billet exiting from the rolling mill is 130 m long; there is a need for the shears to make an intermediate cut, for example into two 65 m bars, so that the bars may be conveniently accommodated on the cooling bed and cooled. Cooling shortens the bar by a few centimeters, in addition to twisting it sometimes, since it may not be performed in the most suitable manner due to air currents or the different sizes between adjacent bars which undergo uneven cooling due to the spaces therebetween and the often different lengths thereof.

Therefore, a bar straightening and cold cutting unit, for example by means of trimmers, is provided downstream of the cooling bed. This last unit is adapted to obtain lengths of final product as a function of the various desired types according to the production sheet. It indeed attempts to make cuts so as to minimize the losses of material due to parts which cannot be straightened and short bars. Clearly, the portion of product cropped in this passage is also lost.

The bars cut to size are then sent to a series of beds downstream, each intended to accommodate products having specific lengths, so as to form bundles and tie and strap them.

It therefore may be understood how the rolling process and division of the billets in known rolling mills of the merchant type involves increased losses of material in the various steps of the process, thus lowering the output of the plant and increasing production costs.

SUMMARY OF THE INVENTION

Therefore, it is an object of the present invention to increase the output of a process for producing metallurgical products, in particular of the merchant type.

In particular, it is a further object of the invention to minimize the cutting operations of a casting product.

It is a particular object of the present invention to allow the production of metallurgical products, at least of the merchant type, in an endless or semi-endless mode without affecting the quality of the product.

It also is an object of the invention to optimize the energy efficiency and to have low production and maintenance costs of a casting and rolling apparatus.

The present invention achieves at least one of such objects, and other objects which will become apparent in light of the present description, by a process for producing metallurgical products, in particular at least of the merchant type, in which there are provided the steps of:

a) producing a long casting product by means of a continuous casting machine;

b) rolling said long casting product by means of a rolling mill comprising a plurality of rolling stand groups, or rolling stations;

in which during step b), said long casting product is heated by first heating means exclusively arranged between one pair of consecutive rolling stand groups;

wherein said first heating means are the only heating means between the rolling stand groups of the rolling mill.

The invention also relates to a casting and rolling apparatus being particularly capable of working in an endless and/or semi-endless mode, comprising:

a continuous casting machine adapted to produce a long casting product;

and a rolling mill adapted to roll said long casting product, comprising a plurality of rolling stand groups;

wherein there are provided first heating means adapted to heat said long casting product;

wherein said first heating means are exclusively arranged between one pair of consecutive rolling stand groups, or in other words, between a single pair of consecutive rolling stand groups;

and wherein said first heating means are the only heating means between the rolling stand groups of the rolling mill.

The rolling stand groups may also be referred to as rolling stations. Each rolling station may comprise one or more rolling stands, preferably a plurality of rolling stands.

Advantageously, since the aforesaid first heating means are provided, the long casting product is provided with sufficient heat to ensure that by operating in an endless mode, the temperature of the long casting product does not drop below a critical temperature during the rolling, in particular equal to 800° C., preferably 850° C., so as to avoid the occurrence of defects.

Advantageously, said first heating means are exclusively arranged between one pair of consecutive rolling stand groups;

and said first heating means are the only heating means between the rolling stand groups of the rolling mill.

Such features have been accurately selected so as to optimize the heating of the long casting product, in particular so as to save energy and reduce the costs for manufacturing and servicing the apparatus.

In the present description, "merchant type metallurgical products" and "merchant type bars and beams" mean a set of profiles including flat bars, section bars, angle bars of various types, for example U, T, V, L, H, C, UPN angle bars, beams, bars of over 20 mm in size.

As known to those skilled in the art, a "long" casting product, in particular, means a product having a polygonal section, in particular square, rectangular or octagonal, or having an oval or round section. In particular, when the long casting product has a rectangular section, the ratio between wide side (or longest side) and narrow side (or shortest side) of the section is less than 4, i.e. the length of the wide side is less than 4 times the length of the narrow side. In particular, said section is considered on a plane orthogonal to the longitudinal axis of the long casting product. A "long" casting product gives rise to semi-finished products defined as billets or blooms. A "long" casting product is different from a flat casting product, which instead is referred to as a slab and is characterized by the increased width with respect to thickness.

"Endless" mode particularly means a process (or operating mode) in which the long continuous casting product transiting along all the steps of the rolling mill remains linked, in particular in direct link, or in other words in continuous link, with the continuous casting machine upstream.

Instead, in a billet-to-billet process, the length of the cast billets is fixed and predetermined, for example equal to 12 m. The cut occurs downstream of casting, generally by means of oxygen cutting pipes.

"Semi-endless" mode, in particular, means a process in which the continuous casting machine produces a billet (or a bloom) which is separated from the continuous casting machine, usually upstream of the rolling mill, by cutting, said billet varying in length as a function of one or more parameters. However, said length is greater than that of an individual billet produced in a billet-to-billet mode, preferably at least 2 times greater, preferably 2 to 3 times greater. For example, said length may be at least 20 meters, for example from 20 meters to 30 meters.

As mentioned above, in a billet-to-billet process, the individual billets tend to cool at the head and tail and undergo cropping cuts which in addition to decreasing the output thereof, may affect and make it difficult to calculate the finished products which may be made by each billet, resulting in the declassification of certain products to short bars.

Instead, in a semi-endless process according to the invention, the varying length of the billets is particularly determined as a function of the optimization of the finished products to be obtained from said billets.

More specifically, in a semi-endless process according to the invention, said varying length of the billets is preferably determined as a function of the feedback of one or more production parameters, in particular one or more of: the crossing speed of the rolling mill, the wear of the rolling channels and the tolerance on the product measured by the profile detection system, the target finished product to be made, the temperature of the product in the various rolling steps.

Therefore, despite the head and/or tail thereof possibly undergoing cutting, each billet produced in a semi-endless mode is cut by the shears downstream of casting and upstream of the rolling mill so as to be as much as possible a whole multiple of the target product to be produced so as to minimize the occurrence of short bars and the decrease in output.

The semi-endless mode may be employed in place of the endless mode in case of emergency, when there is a need to reduce the speed of the continuous casting machine. In this case, the product exiting from the continuous casting machine may be rolled while however avoiding it from being cooled in an undesired manner.

The semi-endless mode may optionally also be used for production needs, in particular: i) Rolling products having a large (greater linear weight) section which in order to be suitably rolled in an endless mode, would require increased rolling speeds which are not compatible with the speed of the casting machine so as to remain in the temperature ranges required without adding further heating means. Indeed, by cutting the product downstream of the casting (and therefore by freeing it from the casting), the rolling process thereof may be accelerated, unlike the endless mode in which the product is always linked to the casting speed. ii) If the heating means do now allow a sufficient temperature increase to be provided for reaching the finishing group over the desired temperature, it is suitable for freeing the casting and rolling mill so as to accelerate the product and roll it at temperature.

In a semi-endless process, the long casting product takes on the name of transfer bar—whether it is a billet or bloom.

Advantageously, when more than one type of finishing line is provided, the process and the apparatus according to the invention allow varying the offer of finished products that may be produced with a single apparatus (or plant) which may transform—in a limited time and as a function of the production needs—the liquid steel into a finished product of various nature, such as for example one or more of spooled coils, bars, rods, rebar, bars cut to commercial and non-commercial size, wherein all these products can be of the SBQ (steel bar quality) type, i.e. provided with high mechanical properties, in addition to merchant products.

As mentioned above, the process may be performed in an endless or semi-endless mode.

These operating modes are performed by means of a single casting line which feeds a rolling mill, in particular a single rolling mill.

It is convenient to maintain very accurate control over the speed in the various areas of the line and accurate synchronism between casting and rolling. All the speeds in an endless mode are adjusted as a function of the casting speed which, especially for the merchant products, is more restrained with respect to the speeds which may be reached by the known billet-to-billet plants.

Since the crossing speed of the rolling mill in an endless process is limited by the casting speed, the drops in temperature during rolling are felt more.

Therefore, according to the invention, the production line is advantageously provided with heating means, in particular the aforesaid first heating means, which advantageously allow the greatest drop in temperature in an endless or semi-endless process with respect to a billet-to-billet process, to be compensated for.

The heating means, in particular the aforesaid first heating means, act substantially as means for the controlled restoration of the temperature.

Preferably, a cooling or thermal treatment of the product may be performed downstream of the rolling mill, before the product enters a finishing line, in particular before being cut, in particular so as to obtain a controlled abatement of the temperature thereof.

Advantageously, the process and the apparatus according to the invention allow thermomechanical rolling to be performed.

In particular, one or more heating operations of the product may be performed by suitably located heating means and one or more cooling operations may be performed by means selectively activated along the line in order to give the various types of products which may be obtained particular mechanical properties by controlling the size of the grains.

The thermomechanical treatment which may be performed preferably, but not exclusively, provides rolling at a controlled temperature which ranges, according to the literature, between 930° C. and 700° C. according to known curves depending on the percentage of carbon contained in the product.

Advantageously, efficient thermomechanical rolling allows giving the products increased mechanical properties without increasing the amount of alloy elements. Therefore, more precious steel grades, or equal steel grades but with a saving of alloy elements, may be obtained with the same starting chemistry.

It should be noted that thermomechanical rolling is not performed in existing merchant plants in the prior art due to the absence of systems for recovering the temperature arranged downstream of the billet heating furnace. Therefore, fine-tuning the temperature required for applying thermomechanical rolling is not always easy, at least in the last rolling steps.

Instead, a thermomechanical rolling may be performed with an apparatus and process according to the invention, in particular by means of actively managing the temperature with a combination of heating systems such as, for example one or more inductor induction furnaces, optionally helped by optimized insulation and distances.

Preferably, but not exclusively, all the embodiments are provided with, upstream of the rolling mill, heating means, or second heating means, adapted to heat the long casting product, and/or heating means, or third heating means, adapted to equalize the temperature of the long casting product. Preferably, said equalization is performed both in longitudinal direction and on the cross section.

Preferably, but not exclusively, all embodiments are provided with, in sequence and arranged upstream of the rolling mill and downstream of the continuous casting machine: shears, an emergency unloading bed and further shears (said further shears are upstream of the aforesaid second heating means, when they are provided). This configuration is particularly useful under emergency circumstances or for scheduled stops, as is further explained below.

Further features and advantages of the invention will become more apparent in light of the detailed description of non-exclusive embodiments.

The dependent claims describe particular embodiments of the invention.

BRIEF DESCRIPTION OF THE DRAWINGS

In the description of the invention, reference is made to the accompanying drawings, which are provided by way of non-limiting example, in which.

The same elements, or functionally equivalent elements, have the same reference numeral.

DESCRIPTION OF EXEMPLARY EMBODIMENTS OF THE INVENTION

Figure 1A:
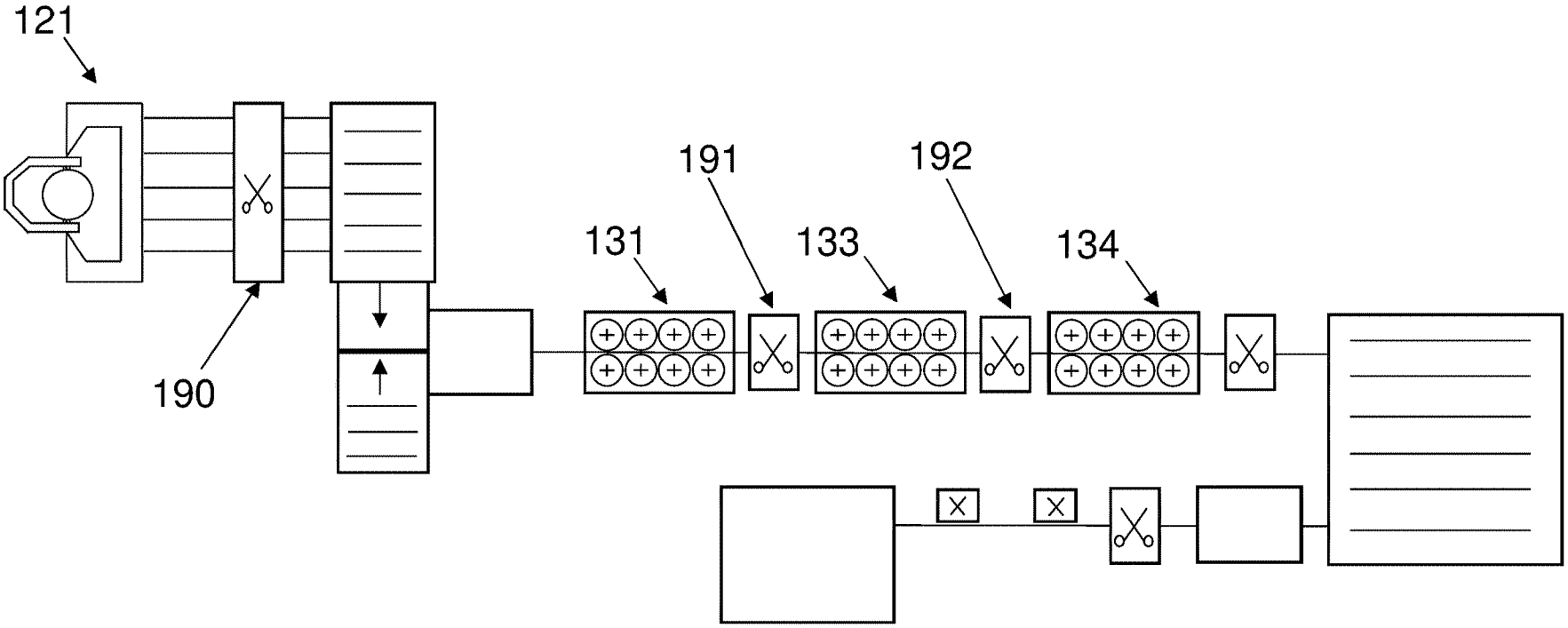
Fig. 1A (Prior art)
FIG. 1A diagrammatically shows a layout of an apparatus according to the prior art.

With reference to the drawings, a process for producing metallurgical products, in particular at least of the merchant type, is described, wherein there are provided the steps of:

a) producing a long casting product 9 by means of a continuous casting machine 21;

b) rolling said long casting product 9 by means of a rolling mill 30 comprising a plurality of rolling stand groups, or rolling stations;

wherein during step b), said long casting product 9 is heated by first heating means 32 exclusively arranged between one pair 31, 33; 33, 34 of consecutive rolling stand groups, i.e. arranged between only one pair of consecutive rolling stand groups;

wherein said first heating means 32 are the only heating means present between the rolling stand groups 31, 33, 34 of the rolling mill 30.

In particular, the heating by said first heating means 32 is the only heating of the long casting product 9 performed during step b) and/or the heating by means of said first heating means 32 is the last heating to which the long casting product 9 is subjected.

Preferably, said rolling mill 30 rolls the same long casting product 9 while it is linked, in particular in direct link, with the continuous casting machine 21.

Preferably, said long casting product 9 is cut only downstream of said rolling mill 30 and/or said long casting product 9 is cut only upstream of said rolling mill 30, preferably except under emergency circumstances. In particular, said long casting product 9 is preferably cut only downstream of the last rolling stand (i.e. downstream of the last rolling stand group) and/or said long casting product 9 is cut only upstream of the first rolling stand (i.e. of the first rolling stand group), preferably except under emergency circumstances.

Preferably, but not exclusively, the long casting product 9 produced during said step a) has a polygonal section, preferably octagonal, square, or rectangular, or oval or round.

A casting and rolling apparatus or plant is also described, the apparatus being particularly capable of working in an endless and/or semi-endless mode. In all the embodiments, the apparatus comprises:

a continuous casting machine 21 adapted to produce a long casting product 9;

and a rolling mill 30, preferably a only one rolling mill 30, adapted to roll said long casting product 9, comprising a plurality of rolling stand groups, or rolling stations;

wherein there are provided first heating means 32 adapted to heat said long casting product 9;

wherein said first heating means 32 are exclusively arranged between one pair 31, 33; 33, 34 of consecutive rolling stand groups, i.e. they are arranged between only one pair 31, 33; 33, 34 of consecutive rolling stand groups;

and wherein said first heating means 32 are the only heating means between the rolling stand groups 31, 33, 34 of the rolling mill 30.

The apparatus defines a processing line.

"Consecutive rolling stand groups" or "consecutive rolling stations" means, in particular, rolling stand groups arranged in sequence one after the other along the processing line. There are no other rolling groups or stations between consecutive groups or stations.

The number of rolling stand groups of the rolling mill 30 may be two or more or three or more.

Preferably, said first heating means 32 are the last heating means of the processing line defined by the apparatus.

The aforesaid pair of rolling stand groups may consist of the first rolling stand group 31 and the second rolling stand group 33 of the rolling mill 30. This arrangement is particularly advantageous because less power may be provided to the first heating means 32.

In this case, the number of rolling stand groups of the rolling mill may be equal to two or may be greater than two, for example equal to three, or may be greater than three.

"First rolling stand group 31 of the rolling mill 30" means, in particular, the first group with respect to the apparatus processing line. In particular, the first group 31 is the group closest to the continuous casting machine 21.

The second group 33 is the group immediately following the first group 31.

Said pair of rolling stand groups may alternatively consist of the second rolling stand group 33 and the third rolling stand group 34 of the rolling mill 30.

In this case, the number of rolling stand groups of the rolling mill may be equal to three or may be greater than three.

The third group 34 is the group immediately following the second group 33.

In any case, the first group 31 preferably is a roughing group, i.e. it is adapted to perform one or more roughing operations of the long casting product 9.

The last rolling stand group of the rolling mill 30 ("last group" with respect to the processing line) preferably is a finishing group, i.e. it is adapted to perform one or more finishing operations of the long casting product 9.

Figures 2A, 2B:
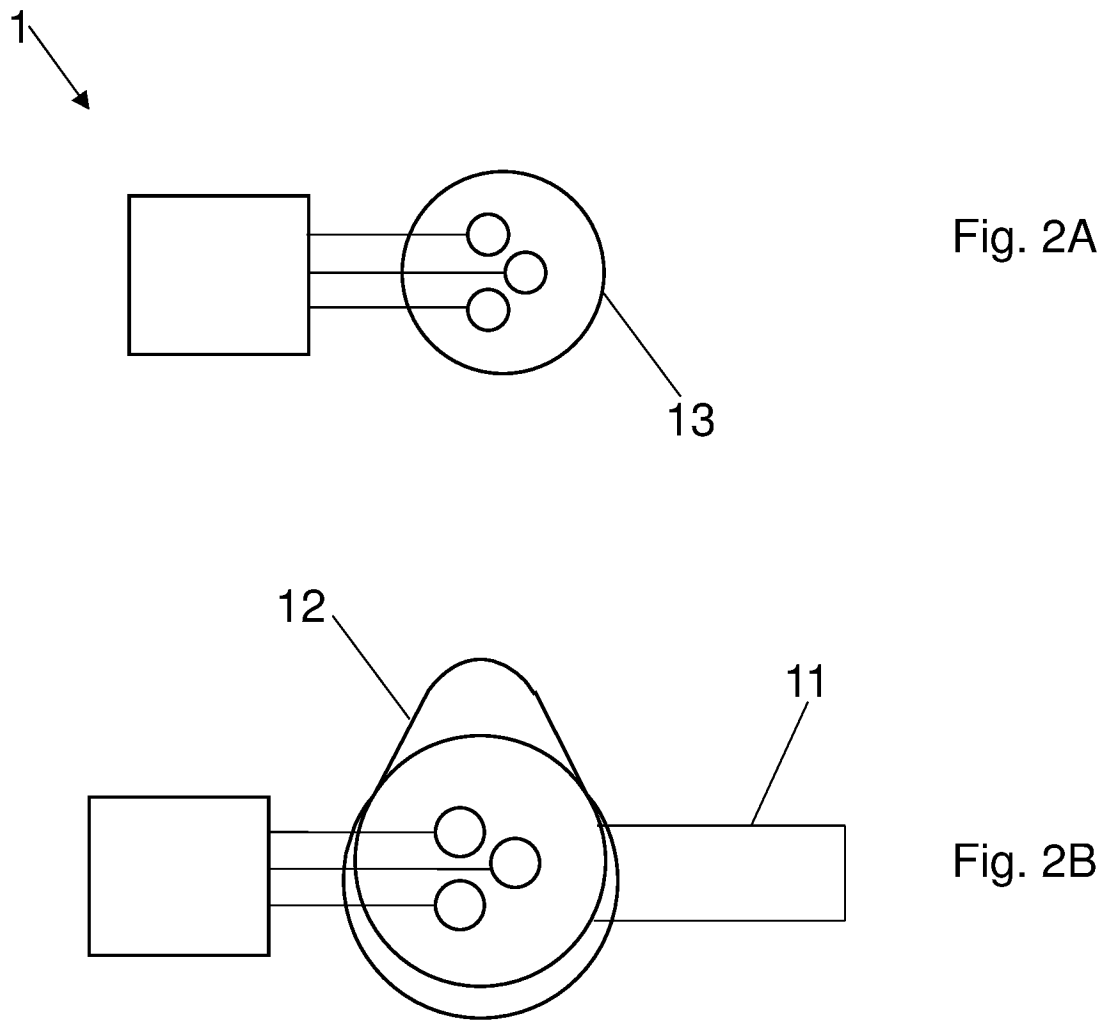
FIG. 2A diagrammatically shows the layout of part of an apparatus according to the invention.
FIG. 2B diagrammatically shows the layout of part of an apparatus according to the invention.

With particular reference to FIGS. 2A and 2B, the apparatus preferably comprises a group of machinery, referred to as a metallurgical group 1 or metallurgical area, which comprises at least one melting furnace 12 and at least one ladle furnace 13 (LF).

The melting furnace 12 preferably is an electric arc furnace (EAF). The melting furnace 12 may be supplied in any known manner, by means of supplying means 11, preferably by means of an endless charging system (ECS).

The ladle furnace 13 serves to refine the molten steel in order to give it the suitable chemical structure to make the desired finished product.

Optionally, the metallurgical group 1 further comprises one or more machines (not shown) for vacuum treating the refined liquid metal downstream of the ladle furnace 13.

Figure 1:
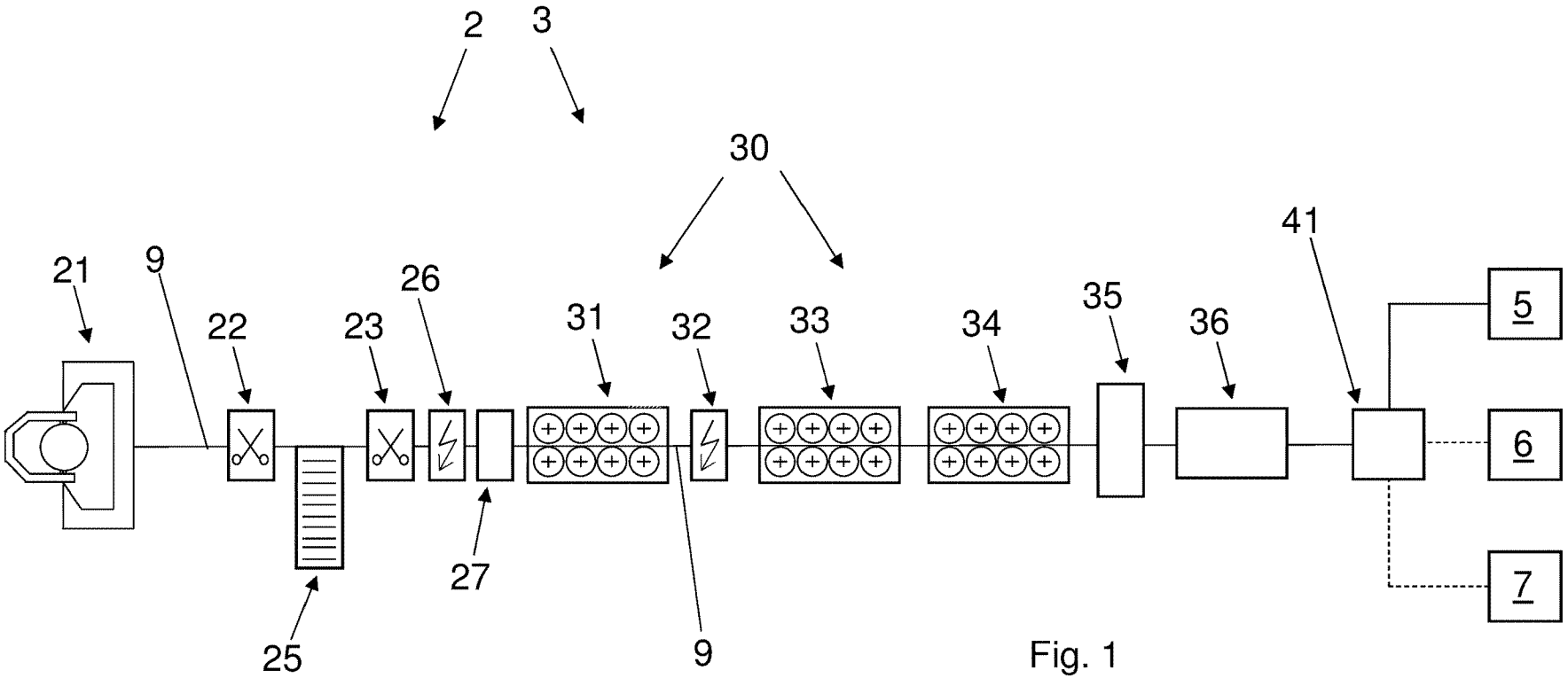
FIG. 1 diagrammatically show a layout of an apparatus according to the invention.

With particular reference to FIG. 1, the apparatus comprises a group of machinery, referred to as a casting group 2, downstream of the metallurgical group 1 (when provided).

The casting group 2 comprises a continuous casting machine 21 for long casting products.

The continuous casting machine 21 defines, i.e. is provided with, a single casting line.

In particular, said casting line is supplied by the contents of ladles suitably moved in known manner by means of a ladle turret. The contents of the ladles move from a tundish to a cooled and oscillating ingot mold. The liquid metal in contact with the cooled walls of the crystallizer contained in the ingot mold starts solidifying, giving shape to a semi-finished metallurgical product, in particular to the long casting product 9 which more specifically, is a billet or bloom.

As it descends along the casting line, the semi-finished product is further cooled and straightened, switching from a mainly vertical arrangement to a substantially horizontal arrangement.

The apparatus further comprises a group of machinery referred to as a rolling group 3, which comprises a rolling mill 30.

The casting group 2 and the rolling group 3 form a casting and rolling group or line, also referred to as a co-rolling group or line.

The casting and rolling group is designed, i.e. is configured, to work in an endless mode. The processing in an endless mode may also be continued through the known fly tundish mechanism, i.e. the quick replacement between a tundish being emptied with a full tundish, in which the steel grades of the two contents are different from each other. In this case, there will be a first section of cast product consisting of one steel connected by means of a chemically-mixed joint to a second product consisting of a different composition. The cast item is rolled, and the joint section is then discarded by cutting at the end of the rolling.

However, cutting means, for example shears 22 downstream of the continuous casting machine 21, are optionally provided for emergency circumstances, or possibly to work in a semi-endless mode (for example, for certain specific products in which there is a need for a rolling speed which is greater than the maximum endless speed, and therefore it is necessary to free the casting speed from the rolling mill) or for scheduled stops. An emergency unloading bed 25 may optionally follow the shears 22, for possibly unloading billets cut by shears 22 if there are production problems in the machines downstream (for example, in the case of cobbling in the rolling mill 30) so as not to discontinue the production of the continuous casting machine 21.

If the casting speed is particularly elevated (for example, from 6.5 to 7 m/min), the kissing point could pass the position of shears 22, whereby they could not be used for emergency cutting.

Therefore, another cutting means, for example shears 23 used to cut the long casting product 9 in case of an emergency, may optionally be arranged after shears 22, in particular after the emergency unloading bed 25 (when provided). In particular, the distance between the continuous casting machine 21 and shears 23 is preferably selected as a function of the section of the castable product, which at the maximum casting speed, results in a longer liquid cone.

An emergency procedure may be performed by cutting the long casting product 9 with shears 23. Accordingly, the casting parameters slow down in order to cause the liquid cone upstream of shears 22 to retract, the shears 22 are used to cut billets to size to be unloaded onto the emergency unloading bed 25, thus allowing a recovery of material which otherwise would be discarded. Heating means 26, in particular one or more heating units, adapted to heat the long casting product 9 may be arranged downstream of the continuous casting machine 21, in particular downstream of shears 23 (when provided).

Preferably, the heating means 26 are configured to heat the long casting product 9 at a temperature of at least 950° C. or 1000° C., preferably from 950° C. to 1250° C. or from 1000° C. to 1250° C.

Preferably, said temperature is from 950 to 1200° C., preferably from 1000 to 1200° C.; or said temperature is from 950 to 1100° C., preferably from 1000 to 1100° C.

Optionally, further heating means 27, which are particularly adapted to equalize the temperature of the long casting product 9, are provided downstream of the heating means 26. Preferably, the heating means 27 are configured to equalize the temperature both in longitudinal direction and on the cross section.

The heating means 26, and the heating means 27, when provided, comprise or consist of at least one furnace provided with electric heating means, preferably induction heating means or electric resistors, or at least one furnace provided with one or more burners.

Preferably, the heating means 26 comprise or consist of at least one furnace provided with electric heating means, preferably induction heating means or electric resistors; and the heating means 27 comprise or consist of at least one furnace provided with one or more burners.

Optionally, downstream of the continuous casting machine 21, there is a further bed (not shown) for loading billets from the outside if the continuous casting machine 21 is stopped (for example, for maintenance) so that the rolling mill 30 can however work downstream. If the billets are loaded by said further bed, the rolling mill 30 may be supplied with individual billets in a billet-to-billet mode. The rolling line could also be supplied by means of products originating from other casting lines provided with suitable cutting means and an unloading bed adapted to then transfer the cast product to the rolling line, for example by introducing it into the section between the cutting means 22 and the cutting means 23.

Figure 3:
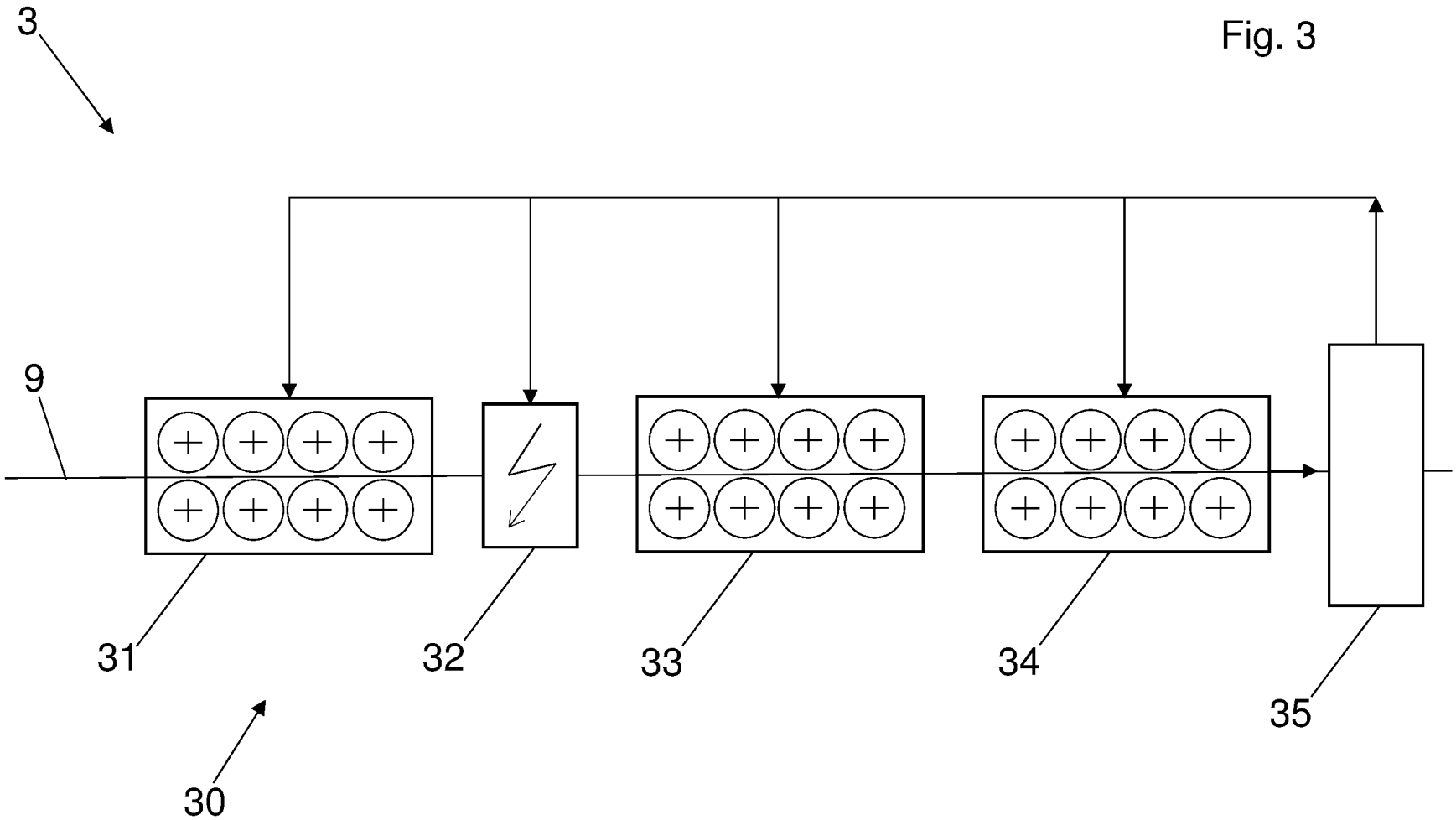
FIG. 3 diagrammatically shows the layout of part of an apparatus according to the invention.

With particular reference to FIGS. 1 and 3, the rolling group 3 is downstream of the casting group 2. The rolling group 3 comprises the rolling mill 30 comprising a plurality of rolling stand groups or rolling stations.

In particular, the first rolling stand group 31 (or roughing group) is adapted to rough the long casting product 9 and the last rolling stand group 34 (or finishing group) is adapted to finish the long casting product 9. The group 34 is particularly arranged downstream of the first group 31. Each group 31, 34 preferably comprises a plurality of rolling stands. By mere way of non-limiting example, the first group 31 has eight rolling stands (only four of them are shown) and the group 34 has six rolling stands (only four of them are shown). The number and configuration of the rolling stands are selected as a function of the product to be produced.

Optionally, as a function of the product to be produced, a stand group 33, also referred to as an intermediate stand group (FIG. 1), having for example four rolling stands, is provided between the first group 31 and the last group 34.

Optionally, emergency cutting means (not shown) are provided downstream of each group 31, 33, 34 and/or for cropping the head of the long casting product, if required.

Advantageously, the first heating means 32 are arranged between the first rolling stand group 31 and the second rolling stand group 33 of the rolling mill 30, or the heating means 32 are arranged between the second rolling stand group 33 and the third rolling stand group 34 of the rolling mill 30.

The heating means 32 allow the long casting product 9 to be heated, in particular to bring it to a temperature above 950° C. or 1000° C. and preferably below 1250° C., so as to avoid the occurrence of defects, in particular so that the temperature of the long casting product 9 does not drop below 800 or 850° C. during the rolling performed by the last group 34.

The positioning of the heating means 32, in particular of the only heating means 32 of the rolling mill 30, was selected in consideration of the fact that the travelling speed of the product in the rolling mill 30, in particular when an endless mode is performed, is slower with respect to the billet-to-billet mode, and the rolling operation results in a further cooling of the long casting product 9. Therefore, the heating means 32, which are suitably located, allow the temperature of the long casting product 9 to be at least partially restored to an optimal value to perform the rolling and avoid defects, and moreover the consumption of power of the heating means 32 may be optimized and the costs for manufacturing and servicing the apparatus in general may be reduced.

The heating means 32, in particular, allow heating the long casting product 9 following the roughing, such that the long casting product 9 has a temperature of at least 800 or 850° C. in the successive intermediate (optional) and finishing passages.

Preferably, the heating means 32 are configured to heat the long casting product 9 at a temperature of at least 950° C., preferably from 950° C. to 1250° C., or of at least 1000° C., preferably from 1000° C. to 1250° C.

Preferably, said temperature is from 950 to 1200° C., preferably from 1000 to 1200° C.; or said temperature is from 950 to 1100° C., preferably from 1000 to 1100° C.

When the intermediate group 33 is provided, the heating means 32 are preferably arranged between the first group 31 and the intermediate group 33, although they may alternatively be arranged between the intermediate group 33 and the finishing group 34 or last group.

The heating means 32, for example comprise or consist of at least one furnace provided with electric heating means, preferably induction heating means or electric resistors, or at least one furnace provided with one burner. Preferably, the heating means 32 comprise or consist of one or more induction furnaces.

Advantageously, the heating means 32 allow thermomechanical rolling to be performed.

By mere way of non-limiting example, the temperature of the long casting product is increased and equalized by the heating means 26, 27 at a temperature which preferably is higher than 1200° C., in particular up to about 1250° C., preferably up to a temperature lower than 1250° C. or than 1200° C.

The temperature decreases as the product proceeds to the roughing operation by means of the first rolling stand group 31.

Advantageously, the temperature of the long casting product 9 is then brought back by the heating means 32 to a temperature comprised, for example between 1100 and 1200° C., so that the temperature thereof at the end of the rolling process is at least 800 or 850° C. in the successive rolling steps by the rolling stand groups 33 and 34.

Preferably, a system 35 (FIG. 3) for detecting the profile of the product is provided downstream of the last rolling stand group 34 in order to ensure it is within the desired size tolerance so as to possibly make the suitable changes to the gaps of the rolling stands and possibly to the alignment of the roller guides (not shown), and/or to the drawing loopers (not shown), and/or to the other components of the known type required for rolling long products, directly in line without the need to stop production.

When the rolling stands are changed to produce different products, there is indeed a need to process only the first piece of bar to perform the correct alignment of stands and guides, by calibrating the system as a function of data provided by the profile detection system 35.

The use of cartridge stands is preferred in order to quickly change stands between the production of one type of product and another, which cartridge stands may be removed and inserted from/on the line through specific carriages of the known type. For example, the intermediate rolling stand group and finishing rolling stand group may be provided with quick exchange belts to change the product while minimizing the change times with which the stands are changed.

However, use is preferably made of the known free-sizing concept—i.e. adjusting the gap of the rolling channels to roll various sections without the need to change the stands—to minimize the changing frequency if products with similar sections are to be processed.

Said adjustment is much easier with respect to the process for producing merchant products in a billet-to-billet mode. Indeed, the heads and tails of each rolled billet disadvantageously are colder in a billet-to-billet process. This has repercussions on the deformation applied by the rolling steps, with the possibility for the same product along the length thereof to have different temperatures, and therefore also different sizes, at the end of the rolling process, with the risk of repercussions on the tolerances.

Instead advantageously, the temperature along the product is constant or substantially constant in an endless process according to the invention.

Preferably, there are cooling and/or thermal treatment means 36 (FIG. 1) which serve to give product 9 the desired mechanical properties downstream of the last rolling stand group 34, in particular downstream of system 35.

Preferably, the long casting product is brought to a temperature between 710 and 920° C. by the cooling and/or thermal treatment means 36.

Said cooling and/or thermal treatment means 36 preferably comprise or consist of a spray box system, or more generally, a system adapted to dispense water and/or air.

The spray box system is a system comprising a plurality of nozzles, one or more of which are activated or not activated as a function of the geometry of the product to be treated. When they are activated, the nozzles may dispense water and/or air. Since merchant products have complex geometries, the nozzles may be activated to cool only certain surfaces of the product.

FIG. 3 also uses arrows to show diagrammatically a control method of the feed-forward type, for controlling the rolling parameters as a function of the dimensional instructions downstream of the rolling mill 30 detected by means of the profile detection system 35. As mentioned above, the rolling parameters which may be changed may be, for example the gaps of the rolling stands and/or the alignment of the roller guides (not shown) and/or the loopers (not shown) for the drawing feedback.

The loopers, in particular, provide a feedback on the drawing between two rolling stands with which the revolutions of the rolling stands are adjusted to obtain the desired drawing (tension).

The apparatus comprises one or more finishing lines 5, 6, 7 (FIGS. 1, 4, 5 and 6) downstream of the rolling mill 30, in particular downstream of the cooling and/or thermal treatment means 36.

In particular, the apparatus preferably comprises at least one finishing line 5 adapted to produce metallurgical products of the merchant type, and optionally at least one or at least two further finishing lines 6, 7, in particular distinct from the finishing line 5.

When more than one finishing line is provided downstream of the rolling mill 30, in particular downstream of the cooling and/or thermal treatment means 36, a deflector 41 adapted to direct the long casting product 9 out from the rolling mill 30 towards one of the finishing lines 5, 6, 7, is provided.

In particular, the finishing line 5 is a cutting, forming and unloading line of merchant type products, in particular of bundles of merchant bars.

Figure 4:
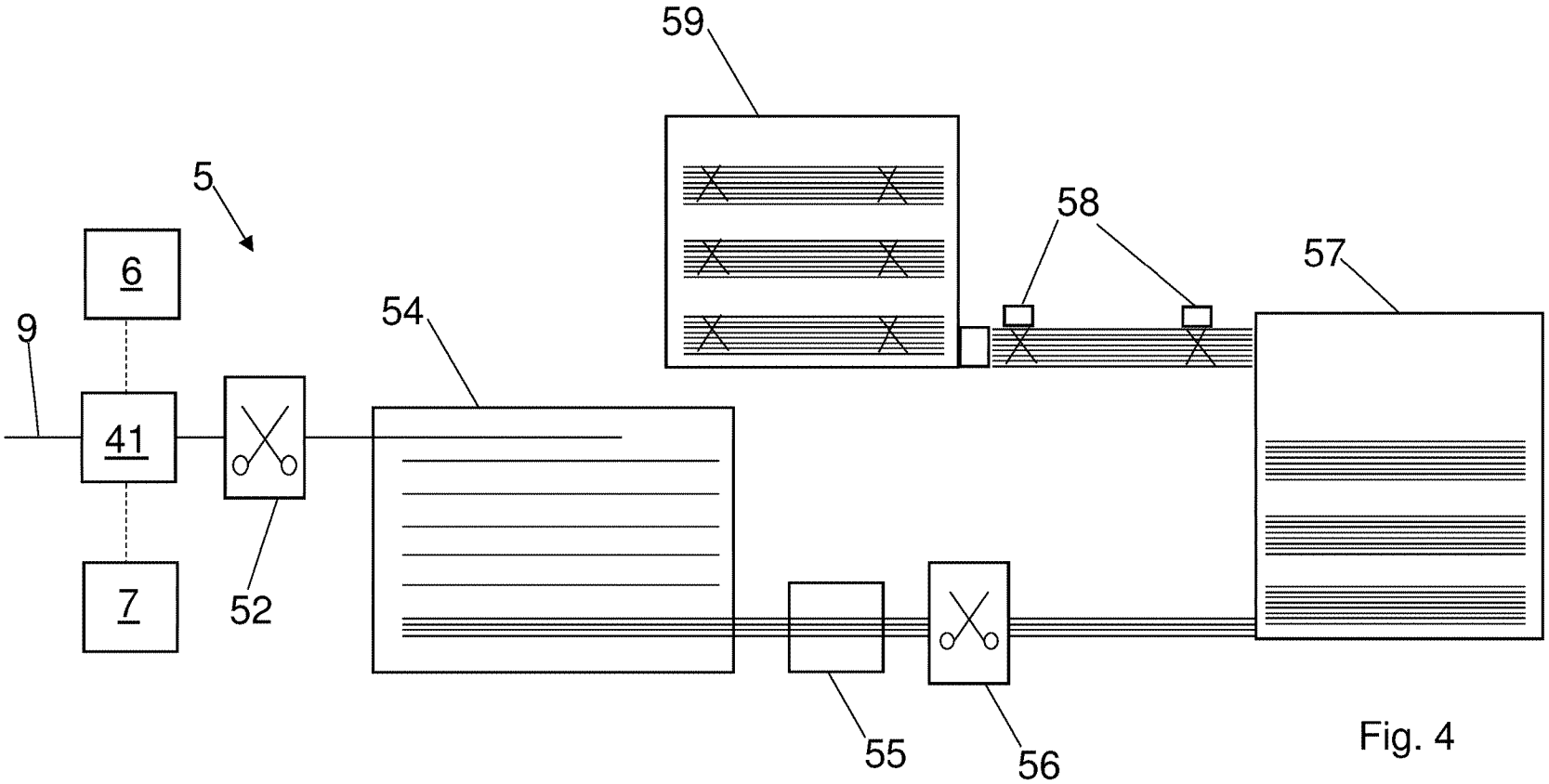
FIG. 4 diagrammatically shows the layout of part of an apparatus according to the invention.
Figure 4B:
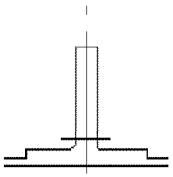
FIG. 4B shows the section of another non-limiting example of a merchant type product.
Figure 4A:
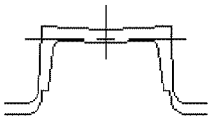
FIG. 4A shows the section of a non-limiting example of a merchant type product.

With particular reference to FIG. 4, the finishing line 5, downstream of deflector 41, comprises cutting means, in particular shears 52 adapted to cut, in particular hot cut, the long casting product 9. In particular, shears 52 are hot shears ("hot" meaning temperatures of the long casting product 9 which preferably are greater than 400° C.).

The merchant bars are sent from deflector 41 by means of a roller table (not shown) towards a cooling bed 54, or merchant cooling bed, arranged downstream of shears 52.

It should be noted that, in an endless mode, the merchant bars are still linked with the continuous casting machine 21: when the desired length is reached, shears 52 cut the bar so it may be accommodated in the cooling bed 54.

Since producing merchant bars is preferably performed at high speeds (also 15 m/s) with hot product having considerable length (tens of meters), the cut is not always accurate and the bars might not all be the same length due to the thermal expansion to which the product is subjected. To obviate this problem, the bars are preferably cut longer than required to then be cooled and cold cut in a successive processing operation.

Once cut by shears 52, the bar is transferred on the cooling bed 54 which, in particular, transports it to the opposite side. The unloading from the cooling bed 54 occurs by groups of bars which are possibly straightened by means of a straightening group 55, preferably by means of a multiple straightener.

There are cutting means downstream of the straightening group 55, in particular shears 56 adapted to cut, in particular cold cut the bars, in particular groups of bars. In particular, shears 56 are cold shears.

In particular, shears 56 are adapted to cut the bars when they have a temperature below 100° C.

Once the straightening of the group of bars is complete, the shears 56 may easily perform the cut to size.

Indeed, when the bars reach this step, they have had a chance to cool down and then, following straightening, to reach the final length thereof. Thereby, the cut may be performed on bars which do not have alterations to the length, and therefore may be cropped to all have the same length. Specific mechanical stops (not shown) are preferably provided, which allow making bars all cut equally.

The shears 56 also allow the head and/or tail of the bars—which are known to be difficult stretches to effectively straighten—to be cropped.

The groups of bars all cut to size are then brought to a bed 57 for forming bundles of merchant bars. The bars are preferably moved from one part of the bundle forming bed 57 to the other, for example by means of an oscillating bench system (not shown). There is a bar storage (not shown) which allows forming merchant bar bundles on the side opposite to the bar inlet side.

The bundles of bars thus obtained are then transported towards a finished bundle unloading bed 59 and are preferably tied by a tying machine system 58 during transport.

Advantageously, there is increased material output with an endless process according to the invention with respect to a billet-to-billet process. Indeed, with the endless process, the long casting product 9 advantageously does not undergo intermediate head and/or trail cropping cuts in the rolling mill 30, as instead occurs with a billet-to-billet process (due to the excessive cooling of the various billets consequently to the various rolling passages) and which are to be refinished downstream of the merchant cooling bed, with further loss of material.

The merchant products rolled in an endless mode indeed are only to be cropped by the cold shears 56 once roughly separated from the hot shears 52.

Moreover, the endless process avoids, or in any case minimizes, the problem of short bars, which instead the prior art suffers from.

Figure 5:
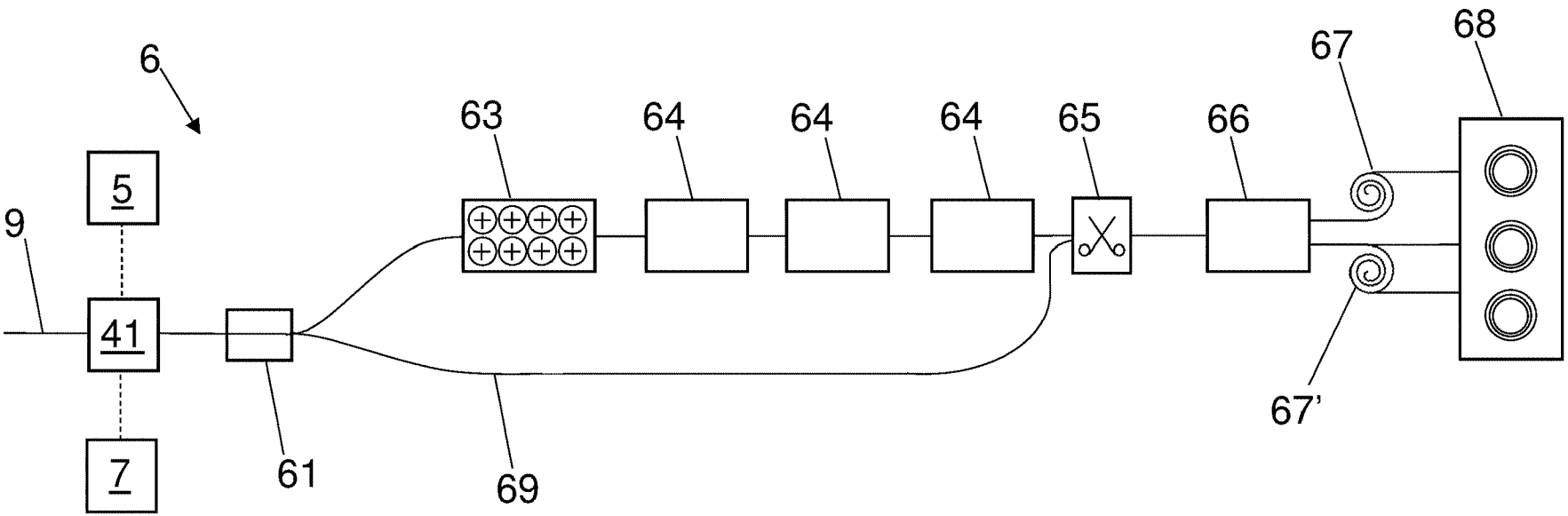
FIG. 5 diagrammatically shows the layout of part of an apparatus according to the invention.

With particular reference to FIG. 5, the finishing line 6 serves to obtain a spooled coil. The finishing line 6 comprises one or more spooling stations 67, 67' (spoolers).

As mentioned above, the long casting product 9 may be directed into the finishing line 6 by means of deflector 41.

According to the treatment to be performed, the product is sent towards a calibrating unit 63 and then crosses thermal treatment systems 64 (for example, water boxes) which may also be arranged in discontinuous manner along the finishing line 6 (as in the example shown).

A to-size cutting system 65, for example by shears, cuts the long casting product 9 while allowing the separation from the upstream section. In an endless mode, the long casting product 9 is still directly linked with the continuous casting machine 21 before the cutting by the cutting system 65.

Alternatively, if the product is not to undergo particular treatments, it may be deflected, preferably by means of a deflector 61 arranged downstream of deflector 41, so as not to pass through the calibrating unit 63. In particular, the long casting product 9 passes from deflector 41 through a by-pass stretch 69 to then be directly directed to the to-size cutting system 65. One or more emergency shears (not shown) may be arranged along the path, for example between deflector 41 and the calibrating unit 63.

Optionally, a further thermal treatment system may be arranged downstream of the to-size cutting system 65. The stretches of commercial material cut to size which are generated by means of the to-size cutting system 65 are then sent by means of pinch-rolls 66 to the spooling stations 67, 67' to be wound into coils which once completed, in turn are sent to the completed coil unloading bed 68. The finishing line 6 is adapted to treat spooled product, for example having section diameters up to 16-25 mm. Advantageously, the finishing line 6 may make bars, rebar, rods of the SBQ (steel bar quality) type.

Figure 6:
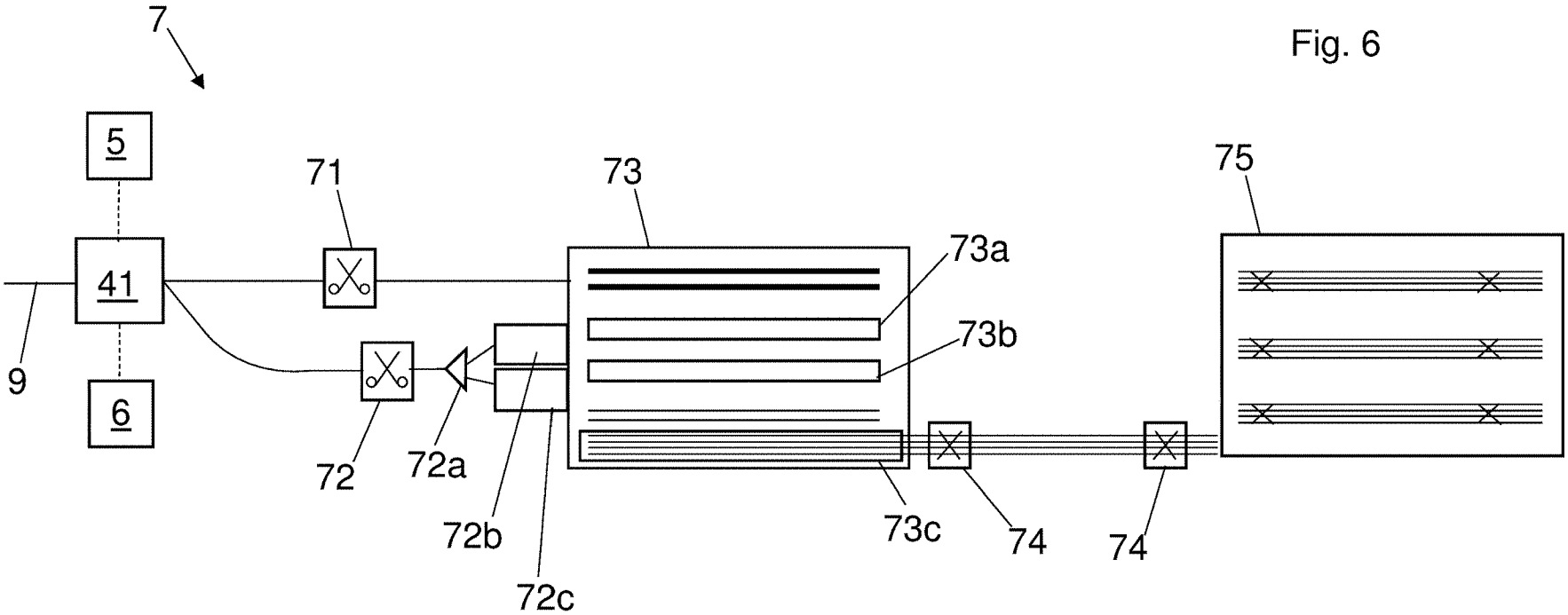
FIG. 6 diagrammatically shows the layout of part of an apparatus according to the invention.

With particular reference to FIG. 6, the finishing line 7 comprises two distinct cutting systems 71, 72, one cutting system 71 for producing bars having a section which is greater than or equal to 20 mm and another cutting system 72 for producing bars having a section less than 20 mm.

The finishing line 7 particularly serves to produce both smooth bars and reinforced bars (rebar).

Advantageously, the finishing line 7 preferably is also capable of making bars of the SBQ (steel bar quality) type.

The finishing line 7 preferably is a line provided with a machine, invented in the past by the Applicant, referred to as DRB (direct rolling and bundling system) for unloading bars cut to commercial length onto a cooling bed.

The bars originating from the rolling mill 30 and possibly cooled by the cooling and/or thermal treatment means 36 are deflected by deflector 41 towards one of the two cutting systems 71, 72 as a function of the diameter of the product obtained from the upstream rolling.

Each of the two cutting systems 71, 72 is adapted to cut a specific type of product and indeed is arranged in one of the two, preferably parallel, lines, which bring the product from deflector 41 to the cooling bed 73, in particular to bed 73 of the DRB. In particular, the cutting systems 71, 72 are arranged downstream of deflector 41; and the cooling bed 73 is in turn placed downstream of the cutting systems 71, 72.

The cutting system 71 preferably comprises or consist of shears 71, in particular hot shears. The cutting system 72 preferably comprises or consist of shears 72, which preferably also are hot shears, and which are preferably adapted to make a quick cut to size since the sizes of the products they are to treat are limited.

Bars of over 20 mm in size pass along the line, for example upper line, which passes through the shears 71, while bars under 20 mm in size pass along the line, for example lower line, passing through the cutting system 72.

The length of the cooling bed 73 is calibrated over a multiple of the commercial length of the bars it is to accommodate.

The lengths preferably are a multiple of 6 m. For example, in a mix of bars having commercial length in which the maximum length of said bars is 24 m, the cooling bed 73 is 24 m long.

The cooling bed 73 may however accommodate bars having smaller length, for example 6, 12 or 18 m.

Before reaching the cooling bed 73, the bars are cut to commercial size by the to-size cutting system 72, which at the same time sorts them by means of a deflector 72*a* into one of the two or more drums 73*a*, 73*b* rotating at a speed which, for example may be from 6 to 7 m/s.

The unloading into cooling bed 73 is performed for bars of under 20 mm in size by means of a rotating drum system 73*a*, 73*b* in which the bars are alternately completely introduced and slowed down in the travel thereof by specific bar brakes 72*b*, 72*c* so as to be overturned on the cooling bed 73, thus being arranged in parallel on the cooling bed 73. The cooling bed 73 then preferably moves said bars towards the opposite side, causing them to fall into a storage 73*c* so as to create layers of parallel bars of equal size.

The bundle of bars obtained is moved and removed from the cooling bed 73 by means of a roller table. While it is brought towards the final unloading bed 75, the bundle of bars is tied by specific tying machines 74 so that it is ready to be sold upon arrival.

For bars of over 20 mm in size—but always of commercial length—which might not be contained in the aforesaid drums 73*a*, 73*b* due to the sizes thereof, the cooling bed 73 is preferably sent to a specific area preferably adjacent to the rotating drums 73*a*, 73*b*, preferably after the cut with the shears 71.

A passage channel is preferably provided, for example a roller table, preferably a curved roller table, which may laterally overturn the bars so that they are arranged on the cooling bed 73. In this case, suitable products are those which are not to be straightened.

Thereby, the bars having commercial length having section greater than 20 mm may be moved from the other side of the cooling bed 73 similarly to the bars having section less than 20 mm, and be accumulated in the storage 73*c* to form a bundle, which is then removed, tied, and arranged for picking on the final bed.

Advantageously, the rotating drums 73*a*, 73*b*, in particular the rotating drums of the DRB (direct rolling and bundling system), make the finishing line 7 particularly, but not exclusively, adapted to making bars of the SBQ (steel bar quality) type.

The invention claimed is:

1. A process for producing merchant bars or beams, wherein there are provided the steps of:

a) producing a billet or bloom by means of a continuous casting machine, the billet or bloom having square cross section, or rectangular cross section with ratio between wide side and narrow side less than 4, or octagonal cross section or oval cross section or round cross section;

b) rolling said billet or bloom by means of a rolling mill comprising a plurality of rolling stand groups;

wherein said rolling mill rolls the same billet or bloom while such billet or bloom is linked with the continuous casting machine;

wherein during step b), said billet or bloom is heated by first heating means exclusively arranged between one pair of consecutive rolling stand groups of said plurality of rolling stand groups;

wherein said first heating means are the only heating means between the rolling stand groups of the rolling mill;

wherein after step b) there is provided a step wherein said merchant bars or beams are produced by means of at least one finishing line arranged downstream said rolling mill, and wherein after the aforesaid step b), there is provided a step of c) cooling and/or thermally treating said rolled billet or bloom by cooling and/or thermal treatment means;

and wherein after the aforesaid step b) and, after step c), there are provided the steps of:

d) cutting said rolled billet or bloom to produce said merchant bars or beams; and e) cooling said merchant bars or beams.

2. The process according to claim 1, wherein the heating by means of said first heating means is the only heating of the billet or bloom performed during step b) and/or wherein the heating by means of said first heating means is the last heating to which the billet or bloom is subjected.

3. The process according to claim 1, wherein said pair of rolling stand groups consists of the first rolling stand group and the second rolling stand group of said plurality of rolling stand groups the rolling mill; or wherein said pair of rolling stand groups consists of the second rolling stand group and the third rolling stand group of said plurality of rolling stand groups of the rolling mill.

4. The process according to claim 1 wherein said billet or bloom is cut only downstream of said rolling mill.

5. The process according to claim 1, wherein said billet or bloom is heated by said first heating means at a temperature which is higher than or equal to 950° C.

6. The process according to claim 1, wherein said billet or bloom is heated by said first heating means at a temperature from 950° C. to 1200° C.

7. The process according to claim 1, wherein said billet or bloom is heated by a second heating means arranged upstream of the rolling mill.

8. The process according to claim 1, wherein a profile detection system arranged downstream of the rolling mill is provided, and wherein one or more rolling parameters are varied as a function of the dimensional indications detected by the profile detection system.

9. The process according to claim 1, wherein after the aforesaid step e), there is provided the step of:

f) cutting said merchant bars or beams.

10. The process according to claim 1, wherein during step b), the first rolling stand group of the rolling mill performs a roughing of the billet or bloom and the last rolling stand group of the rolling mill performs a finishing of the billet or bloom.

11. The process according to claim 8, wherein said rolling parameters comprise gaps of the rolling stands and/or alignment of roller guides and/or tension control by loopers.

* * * * *